US006637908B1

(12) United States Patent
Hung

(10) Patent No.: US 6,637,908 B1
(45) Date of Patent: Oct. 28, 2003

(54) JACK HANDLE WITH A HANDLE TUBE

(75) Inventor: Victor Hung, Lu Chu Hsiang (TW)

(73) Assignee: Shinn Fu Corporation (TW)

( * ) Notice: Subject to any disclaimer, the term of this patent is extended or adjusted under 35 U.S.C. 154(b) by 0 days.

(21) Appl. No.: 10/134,526

(22) Filed: Apr. 30, 2002

(51) Int. Cl.[7] ..... F21V 33/00

(52) U.S. Cl. ..... 362/109; 362/120; 362/208; 362/253; 254/DIG. 3

(58) Field of Search ..... 362/109, 119, 362/120, 234, 253, 486, 208; 254/DIG. 3

(56) References Cited

U.S. PATENT DOCUMENTS 3,936,668 A * 2/1976 Siebel ..... 362/486
6,076,424 A * 6/2000 McMurtrey et al. ... 254/DIG. 3
6,186,638 B1 * 2/2001 Chang ..... 362/119
2003/0043581 A1 * 3/2003 Finnigan ..... 362/253

* cited by examiner

*Primary Examiner*—Stephen Husar
(74) *Attorney, Agent, or Firm*—Bacon & Thomas, PLLC

(57) ABSTRACT

A jack handle with a handle tube. A distal end of the jack handle is connected to a handle lamp. The handle lamp is connected to a distal end of the handle tube by pins, screws, or the like. An end of the handle lamp is combined with an illuminating lamp and the interior of the handle is embedded with batteries. The illuminating lamp is controlled by one of a rotary switch, a pressable switch, or a push-type switch. The handle lamp is detachable from the handle tube.

9 Claims, 5 Drawing Sheets

JACK HANDLE WITH A HANDLE TUBE

BACKGROUND OF THE INVENTION (a) Field of the Invention

The present invention relates to jacks, and particularly to a jack handle with a handle tube, wherein the distal end of a jack is freely detachably connected to a handle lamp.

(b) Description of the Prior Art

The prior art hydraulic jack is installed with a handle tube for being engaged with a pump cover. By operating the pump cover, the lifting arm of the jack can move upwards. The prior art handle tube is a long tunb with a cover at a distal end. A front tube wall has a stop post which is engageable with the pump. A front hole is used to place a release valve. By rotating the release valve, the hydraulic oil can be released.

When the jack is used to lift heavy object, since the shielding of the heavy object, the light will be insufficient (such as repairing a car), and therefore, a lamp is required. However, the operation is inconvenient. Thereby, the user must store and find the lamp.

SUMMARY OF THE INVENTION

Accordingly, the primary object of the present invention is to provide a jack handle with a handle tube is disclosed. A distal end of the jack handle is connected to a handle lamp. The handle lamp is connected to a distal end of the handle tube by pins, screws, or any other ways. A respect end of the handle lamp is combined with an illuminating lamp and the interior of the handle is embedded with batteries. The illuminating lamp is controlled by one of a rotary switch, a pressable switch, a push-type switch. The handle lamp is detachable from the handle tube.

Another object of the present invention is to provide a jack handle with a handle tube, wherein the handle lamp is connected to the distal end of the handle tube by screws or pins.

A further object of the present invention is to provide a jack handle with a handle tube, wherein the handle lamp can be placed with batteries and a switch is installed for controlling the illumination of the handle lamp.

The various objects and advantages of the present invention will be more readily understood from the following detailed description when read in conjunction with the appended drawing.

DETAILED DESCRIPTION OF THE PREFERRED EMBODIMENTS

Figure 1:
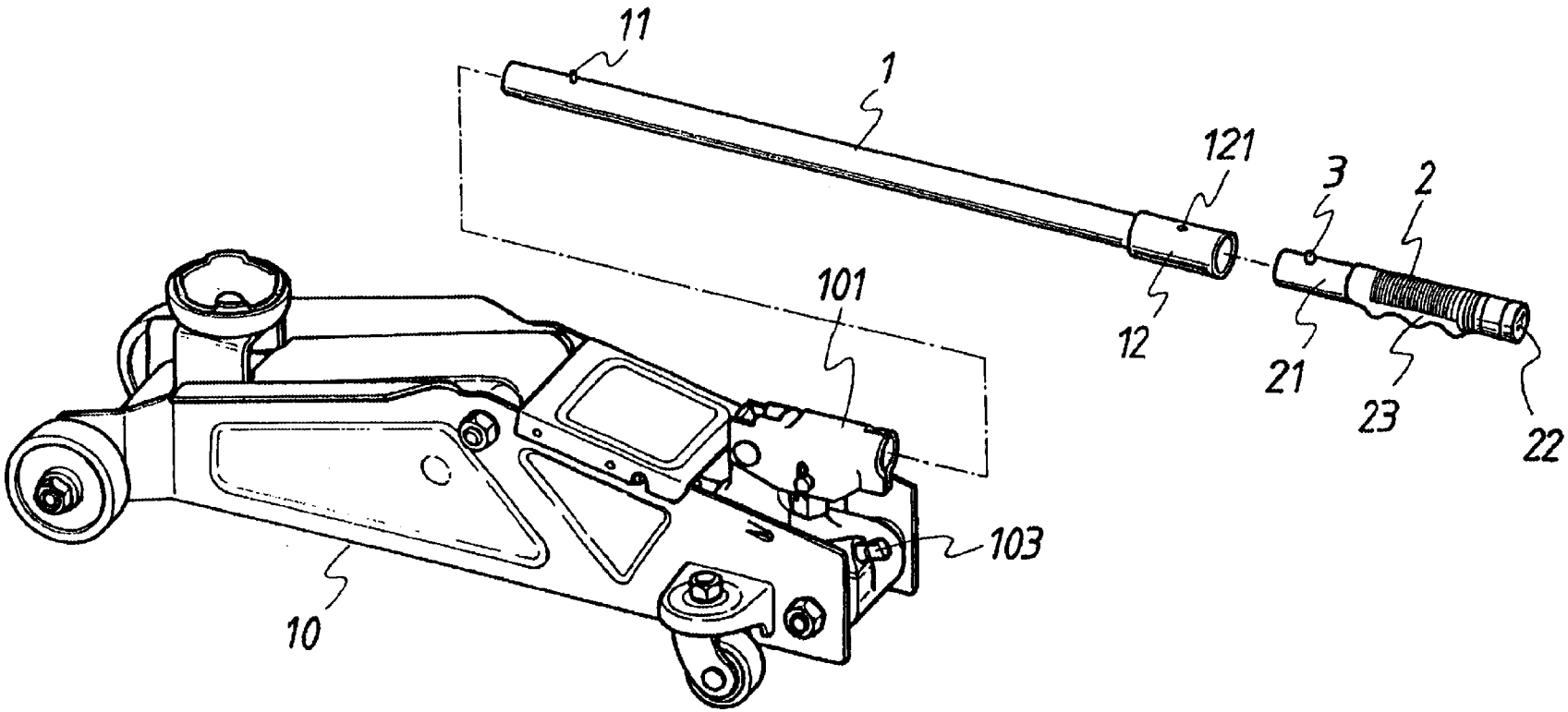
FIG. 1 is an assembled perspective view of the jack of the present invention.

Referring to figures, the jack handle with a handle tube of the present invention is illustrated. A handle tube 1 of a jack

1 is combined with a handle lamp 2. A prior art hydraulic jack 10 is further installed with a release valve 103 for being engaged with a front end of a handle tube 1. Thereby, by rotation the release valve 103, the hydraulic oil can be released.

A tube wall at a front end of the handle tube 1 is installed with a stop post 11 for engaging with the pump cover 101. A front hole 13 of the handle tube 1 can be engaged with the release valve 103 for controlling the closing and opening of the release valve 103. A distal end of the handle tube 1 is installed with a connecting portion 12. The connecting portion 12 can be combined with the handle lamp 2.

The handle lamp 2 is tube-shaped. One end is a respective connecting portion 12 and another end thereof is an illuminating lamp 22. An outer wall of the tube has a cover 23. The connecting portion 12 is detachably connected to the handle tube 1.

Figure 2:
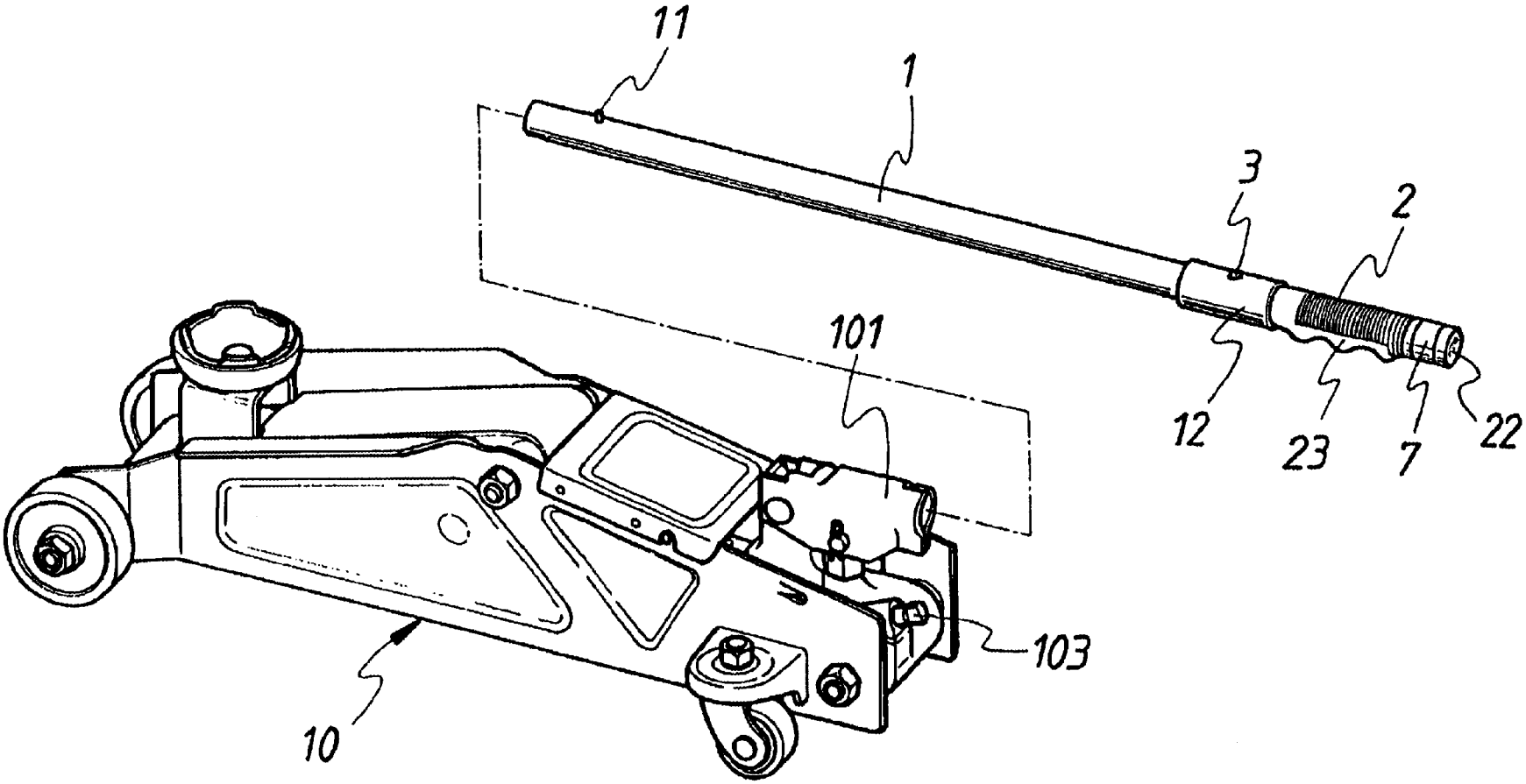
FIG. 2 is an exploded perspective view shown that the present invention is used to a jack.

By combining above handle tube 1 and handle lamp 2, the handle lamp 2 is fixed to the handle tube 1 (referring to FIG. 1). If necessary, the handle lamp 2 can be detached from the handle tube 1 (referring to FIG. 2) for illumination. Thereby, the storage or use of the present invention is convenient.

Figure 3:
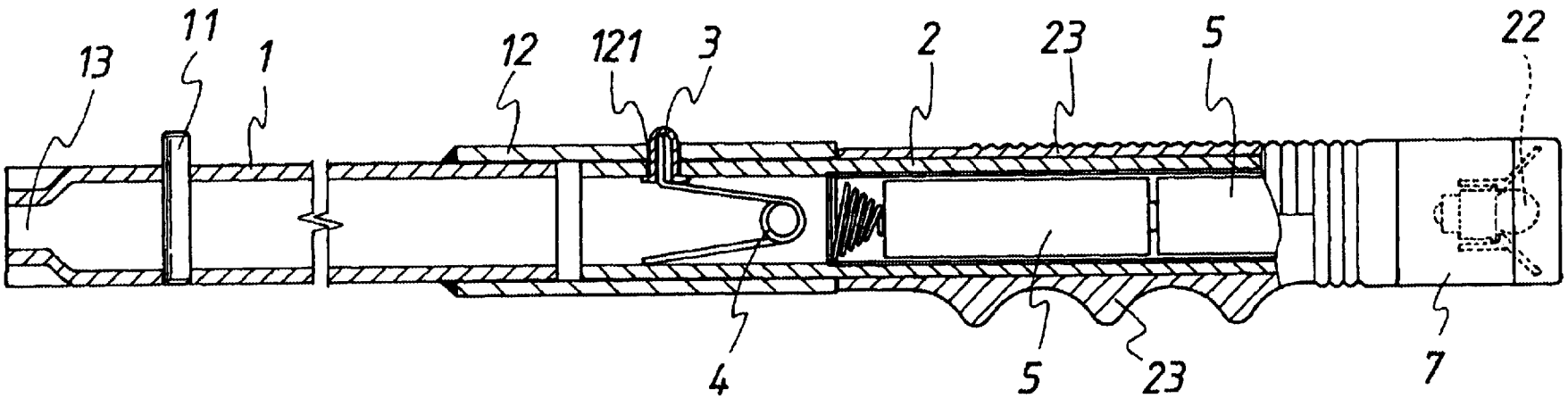
FIG. 3 is an assembled schematic view of the present invention.

Referring to FIG. 3, the handle lamp 2 is connected to the handle tube 1. A movable pin 3 is used to buckle the handle tube 1 with the handle lamp 2. The pin is positioned by a tensional spring 4 secured to the handle lamp 2. The connecting portion 12 of the handle tube 1 is installed with a pin hole 121. The connecting portion 12 may be a sleeve. After the handle lamp 2 is engaged, the pin 3 is buckled to the pin hole 121 so as to detachably connect the two.

Figure 4:
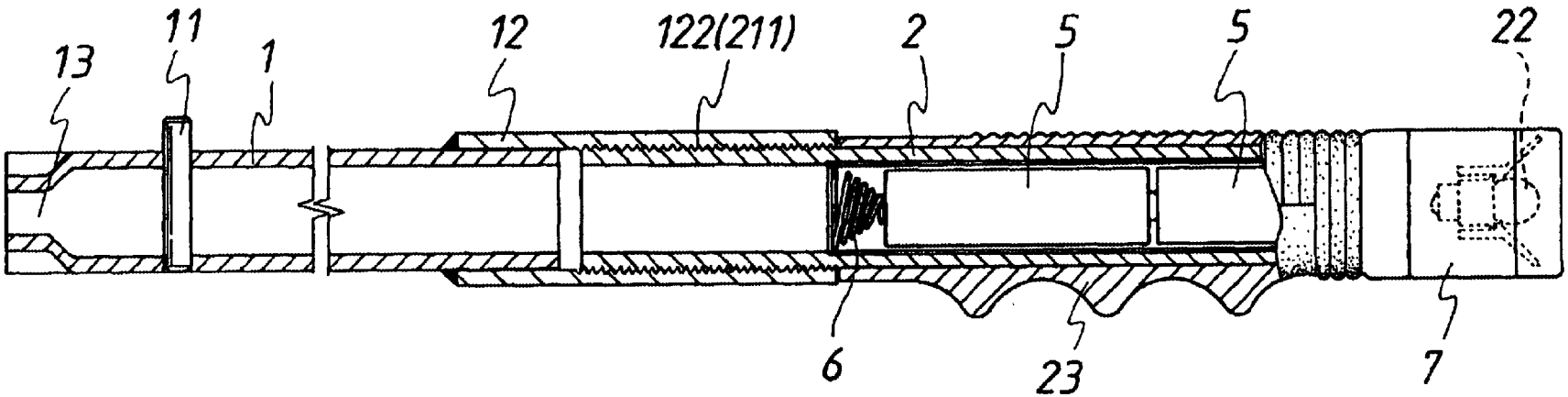
FIG. 4 is an assembled schematic view of another embodiment in the present invention.

Referring to FIG. 4, another embodiment of the present invention is illustrated. The handle lamp 2 and handle tube 1 can be screwedly connected. Namely, the connecting portion 12 of the handle tube 1 and the connecting portion 21 of the handle lamp 2 have threaded sections 122 and 211 so that the two components 1 and 2 can be connected or separated as desired. Two components can be locked as detached as desired. The connecting portion 12 of the handle tube 1 may be a sleeve with inner thread 122 so that the handle lamp 2 can be detachably locked to the connecting portion 12.

Figure 5:
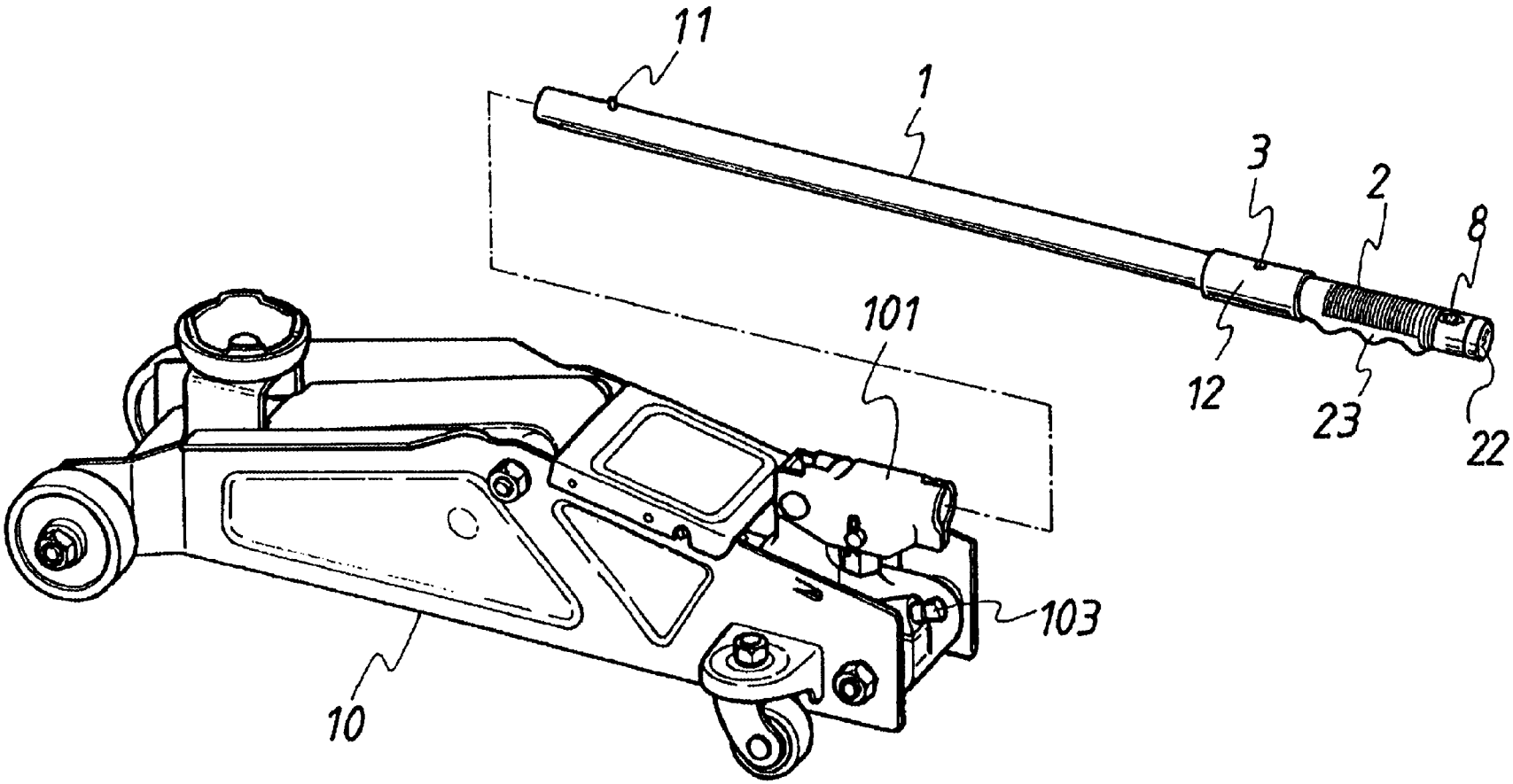
FIG. 5 shows a switch in one embodiment of the present invention.

Inner wall of the handle lamp 2 may place at least one battery. A distal end thereof is embedded with a resisting spring 6. Moreover, a rotary operated switch 7 is installed. Thereby, the illumination of the handle lamp 2 is controllable. The configuration of the switch is not confined. For example, the push button type switch 8 disclosed in FIG. 5 or other push type switch is available.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A handle for a jack, comprising:

a handle tube having first and second ends, a stop post positioned between the first and second ends of the handle tube, a front hole positioned at the first end of the handle tube extending along a longitudinal length of the handle tube and adapted to fit over a release valve of the jack, a handle tube connecting portion at the second end of the handle tube;

a handle lamp comprising a handle lamp connecting portion configured to detachably attach to the handle tube connecting portion, an illuminating lamp, a cover positioned between the handle lamp connecting portion and the illuminating lamp; and wherein the handle lamp is firmly secured to the handle tube and is detachable for independent operation.

2. The jack handle as claimed in claim 1, wherein the handle lamp and the handle tube are connected, and a movable pin is used to connect the handle lamp with the handle tube.

3. The jack handle as claimed in claim 2, wherein the movable pin is positioned by a tensional spring and the connecting portion of the handle tube is installed with a corresponding pin hole.

4. The jack handle as claimed in claim 1, wherein the connecting portion of the handle tube is a sleeve for being engaged with the handle lamp.

5. The jack handle as claimed in claim 1, wherein the handle tube is screwed to the handle lamp.

6. The jack handle as claimed in claim 1, wherein the connecting portion of the handle tube and the connecting portion of the handle lamp have threads, respectively.

7. The jack handle as claimed in claim 1, wherein an inner wall of the handle lamp is placed with at least one battery, and a distal end thereof is embedded with a spring, and a switch is used to control the illuminating lamp.

8. The jack handle as claimed in claim 1, wherein the switch is selected from the group consisting of a rotary switch, a pressable switch, and a push-type switch.

9. The jack handle as claimed in claim 1, wherein an outer wall of the handle lamp includes a handle cover.

* * * * *